US012674370B2

(12) United States Patent
Singh et al.

(10) Patent No.: US 12,674,370 B2
(45) Date of Patent: Jul. 7, 2026

(54) SEALING ELEMENT WITH HIGHER MODULUS REGION

(71) Applicant: Halliburton Energy Services, Inc., Houston, TX (US)

(72) Inventors: Arpana Singh, Singapore (SG); Chad W. Glaesman, Singapore (SG); Sandeep Thatathil, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/227,534

(22) Filed: Jul. 28, 2023

(65) Prior Publication Data

US 2025/0034964 A1 Jan. 30, 2025

(51) Int. Cl.
*E21B 33/12* (2006.01)

(52) U.S. Cl.
CPC ..... *E21B 33/1208* (2013.01)

(58) Field of Classification Search
CPC ..... E21B 33/1208; E21B 33/1277
See application file for complete search history.

(56) References Cited

U.S. PATENT DOCUMENTS 4,700,954 A * 10/1987 Fischer ..... F16J 15/20 277/944
8,336,181 B2 12/2012 Corre et al.
9,322,240 B2 4/2016 Corre et al.
9,322,340 B2 4/2016 VanDerWege et al.
11,248,451 B2 2/2022 Sevadjian et al.
11,365,599 B2 6/2022 Glaesman
11,448,042 B1 9/2022 Glaesman et al.
11,536,110 B2 12/2022 Napier et al.
11,591,879 B2 2/2023 Least et al.
11,692,412 B2 7/2023 Zhong et al.
2005/0127671 A1 6/2005 Ellington et al.
2009/0107664 A1 4/2009 Jara
2010/0288486 A1* 11/2010 Kutac ..... E21B 33/1216 277/336
2013/0206273 A1* 8/2013 Guest ..... B82Y 30/00 977/773
2013/0292123 A1* 11/2013 Murphree ..... E21B 33/138 166/308.1
2014/0060815 A1* 3/2014 Wang ..... E21B 33/1208 166/179
2015/0218903 A1 8/2015 Sellers, Jr. et al.
2016/0002995 A1 1/2016 Naedler et al.
2016/0032681 A1* 2/2016 McGruddy ..... E21B 33/1216 277/336
2020/0199966 A1 6/2020 Napier et al.
2023/0228166 A1 7/2023 Glaesman et al.

OTHER PUBLICATIONS

International Search Report and Written Opinion for International Patent Application No. PCT/US2023/031895 dated Apr. 18, 2024. PDF file. 8 pages.

* cited by examiner

*Primary Examiner* — Kristyn A Hall
(74) *Attorney, Agent, or Firm* — Scott Richardson; C. Tumey Law Group PLLC

(57) ABSTRACT

A variety of methods and apparatus are disclosed, including, in one embodiment, downhole tool for use in a well, comprising: a tool mandrel; a sealing element disposed about the mandrel, wherein the sealing element comprises a lower modulus region and a higher modulus region.

18 Claims, 7 Drawing Sheets

SEALING ELEMENT WITH HIGHER MODULUS REGION

BACKGROUND

Boreholes may be drilled into subterranean formations to recover valuable hydrocarbons, among other functions. Various operations may be performed before, during, and after the borehole has been drilled to produce and continue the flow of the hydrocarbon fluids to the surface.

A typical operation concerning downhole applications may be to apply a seal within a borehole. A seal may isolate and contain produced hydrocarbons and pressures within the borehole. There may be a variety of different tools and equipment used to create seals between the outside of a production tubing string and the inside of a casing string, liner, or the wall of a wellbore. Substantial pressure differentials across a seal may induce failure of the seal and may result in substantial loss of time, money, and equipment, and may even result in harm to individuals. Additionally, expanding a wellbore seal may induce substantial deformation and internal stress on a sealing element, which may increase the chance of failure (e.g., due to breaking or tearing). The design and manufacture of wellbore seals may be limited in structure and material choice in order to minimize the chance of failure. It may be suitable to explore alternative manufacturing processes to produce improved sealing elements.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
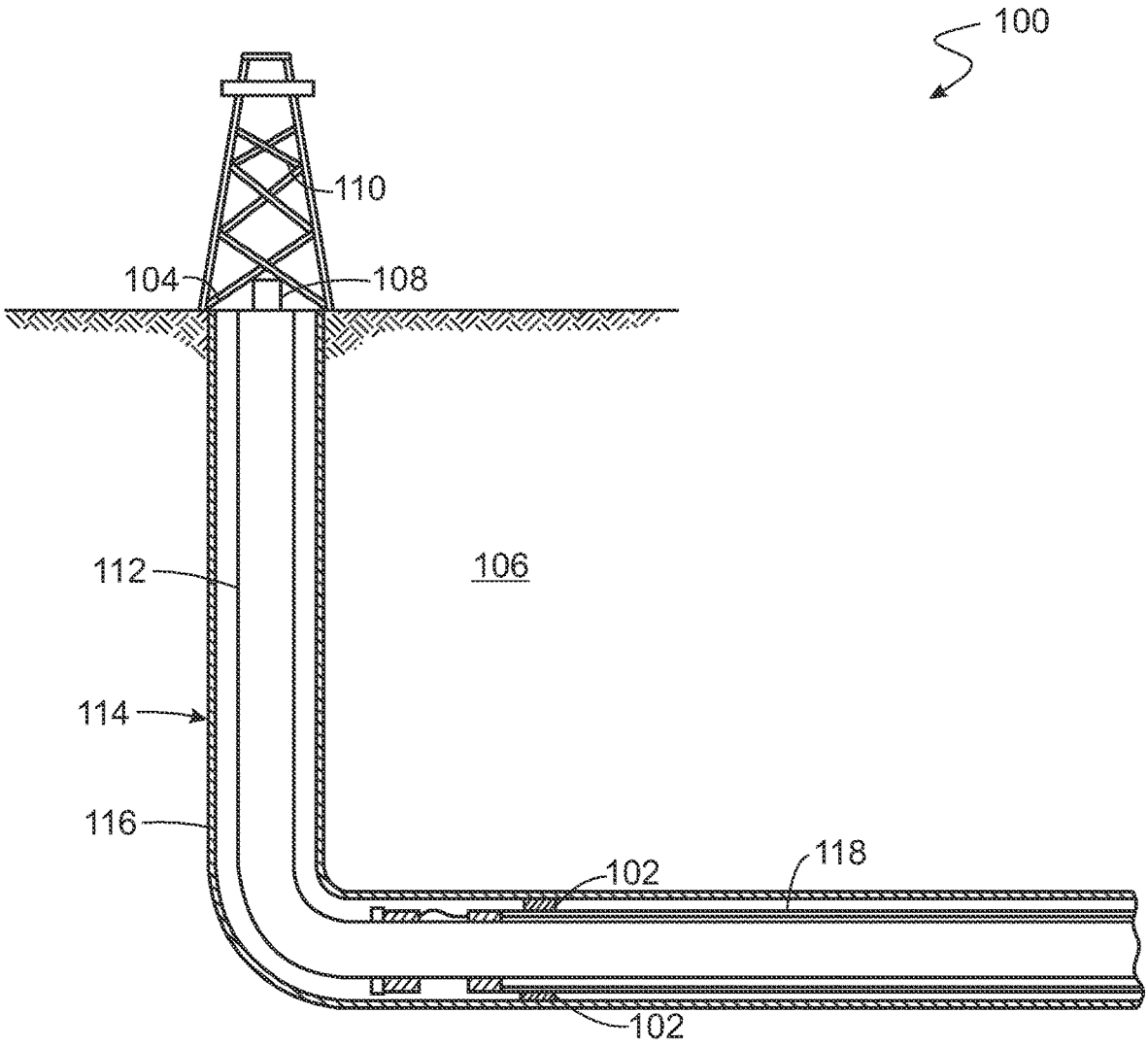
FIG. 1 illustrates a sealing element disposed in a borehole in accordance with some embodiments of the present disclosure.

Disclosed herein are improved sealing elements and, more particularly, sealing elements that have regions with different Young's modulus. By having distinct regions with different Young's modulus, the sealing element may be considered multi-modulus in that the sealing element includes at least two regions with a different Young's modulus. In some embodiments, sealing element has localized fiber loading to provide regions with different Young's modulus.

Young's modulus is a measure of the relationship of an applied stress to the resultant strain. In general, a highly deformable (plastic) material will exhibit a lower modulus when the confined stress is increased. Thus, the Young's modulus is an elastic constant that demonstrates the ability of the tested material to withstand applied loads. Young's modulus as measured using ASTM D412 for elastomers and ASTM D638 for thermoplastics. By including regions with a different Young's modulus in a sealing element, the properties of the sealing element can be optimized to address different challenges.

Sealing elements may generally be elastomeric. While these sealing elements may be able to withstand high pressures, they may be subject to extrusion failure when exposed to high differential pressures. This may result in extrusion of the sealing element along the pressure gradient and the loss of annular seal. In present embodiments, extrusion resistance of a sealing element may be improved by incorporation of a region of higher modulus into the sealing element. For example, the high modulus region may be used at extrusion prone surfaces of the sealing element while other regions of the sealing element are lower modulus. By maintaining regions of lower modulus, the sealing element can maintain flexibility, especially in critical sealing areas, in accordance with some embodiments. Advantageously, the sealing element may have improved extrusion resistance from the higher modulus region while also maintaining desirable sealing properties. The high modulus region may also be incorporated into regions of the sealing element where a high abrasion resistance is required, thus also improving the abrasion resistance of the sealing element.

The sealing element may include at least two regions with a different Young's modulus. To be considered different, the Young's modulus of the regions must vary by about 5% or greater. The sealing element should also maintain significantly large strain capacities, for example, greater than 25% in both regions. Strain capacity is the capability of a material to stretch under pressure and is measured as elongation at break. In some embodiments, the sealing element includes a lower modulus region and a higher modulus region The terms "lower" and "higher" as used with respect to these regions is not intended to imply any specific degree of elasticity but are instead used as terms of degree to degree their relationship to one another. The higher modulus region may be considered a "higher" modulus region because its Young's modulus is higher than the Young's modulus of the lower modulus region.

The lower modulus region may comprise any of a variety of suitable materials for downhole sealing applications. For example, the sealing element may comprise an elastomer. Examples of suitable elastomer include nitrile butadiene (NBR) which is a copolymer of acrylonitrile and butadiene, carboxylated acrylonitrile butadiene (XNBR), hydrogenated acrylonitrile butadiene (HNBR) which is commonly referred to as highly saturated nitrile (HSN), carboxylated hydrogenated acrylonitrile butadiene (XHNBR), hydrogenated carboxylated acrylonitrile butadiene (HXNBR), ethylene propylene (EPR), ethylene propylene diene (EPDM), tetrafluoroethylene and propylene (FEPM), fluorocarbon (FKM), perfluoroelastomer (FEKM), and combinations thereof. Thermoplastics, thermosets, and thermoplastic vulcanizates may also be suitable in some examples. For example, the sealing element may comprise a thermoplastic, such as an epoxy or phenolic. Examples of suitable thermoplastics include polyphenylene sulfide (PPS), polyetheretherketones such as (PEEK), (PEK) and (PEKK), polytetrafluoroethylene (PTFE), and combinations thereof.

The lower modulus region may be included in the sealing element in any suitable amount. For example, the lower modulus region may be included in the sealing element in an amount of about 50% to about 99% by volume of the sealing element. In some embodiments, the sealing element may be included in an amount of about 55% to about 99%, 60% to about 99%, about 70% to about 99%, about 80% to about 99%, about 90% to about 99%, about 50% to about 98%, about 55% to about 98%, about 60% to about 98%, about 70% to about 98%, about 80% to about 98%, about 90% to about 98%, about 50% to about 95%, about 55% to about 95%, about 60% to about 95%, about 70% to about 95%, about 80% to about 95%, or about 90% to about 95% by volume of the sealing element.

The higher modulus region may include a reinforcing agent and a matrix material. The matrix material may include any suitable material, including elastomers, thermoplastics, thermosets and thermoplastic vulcanizates. Examples of suitable elastomer include nitrile butadiene (NBR) which is a copolymer of acrylonitrile and butadiene, carboxylated acrylonitrile butadiene (XNBR), hydrogenated acrylonitrile butadiene (HNBR) which is commonly referred to as highly saturated nitrile (HSN), carboxylated hydrogenated acrylonitrile butadiene (XHNBR), hydrogenated carboxylated acrylonitrile butadiene (HXNBR), ethylene propylene (EPR), ethylene propylene diene (EPDM), tetrafluoroethylene and propylene (FEPM), fluorocarbon (FKM), perfluoroelastomer (FEKM), and combinations thereof. The elastomer included in the matrix material of the higher modulus region may be the same or different than the elastomer of the lower modulus region. In some embodiments, the matrix material may be included in the higher modulus region in an amount of about 60% to about 99% by volume and, alternative, about 65% to about 97% by volume of the higher modulus region. To provide an increased modulus, the higher modulus region may further include a reinforcing agent, such as a powders or fibers. Examples of suitable powers that may be used as the reinforcing agent may include carbon black, fumed silica, treated clay, graphite, and combinations thereof. Where used, the powders can include single walled or multi-walled nano-tubes. Examples of suitable fibers my include glass fibers {e.g., e-glass, A-glass, E-CR-glass, C-glass, D-glass, R-glass, and/or S-glass), cellulosic fibers (e.g., viscose rayon, cotton, etc.), carbon fibers, graphite fibers, metal fibers {e.g., steel, aluminum, etc.), ceramic fibers, metallic-ceramic fibers, aramid fibers, and combinations thereof. Specific examples of suitable fibers include aramids, cotton flock, rayon, polyesters, and polyamides. The reinforcing agent may be included in the higher modulus region in an amount of about 1% to about 40% by volume and, alternatively, about 3% to about 35% by volume of the higher modulus region.

The higher modulus region may be included in the sealing element in any suitable amount. For example, the lower modulus region may be included in the sealing element in an amount of about 1% to about 50% by volume of the sealing element. In some embodiments, the sealing element may be included in an amount of about 1% to about 45%, 1% to about 40%, about 1% to about 30%, about 1% to about 20%, about 1% to about 10%, about 2% to about 50%, about 2% to about 45%, about 2% to about 40%, about 2% to about 30%, about 2% to about 20%, about 2% to about 10%, about 5% to about 50%, about 5% to about 45%, about 5% to about 40%, about 5% to about 30%, about 5% to about 20%, or about 5% to about 10% by volume of the sealing element.

The higher modulus region may have a Young's modulus that is about 5% or greater than the lower modulus region. For example, the higher modulus region may have a Young's modulus that is 5% to about ** % greater than the lower modulus region. In some embodiments, the higher modulus region may have Young's Modus that is 1 time, 2 times, 3 times, 5 times, or even 100 times greater than the lower modulus region. The specific difference may depend, for example, on the composition of each region and the particular reinforcing agent used. For example, a higher modulus region that comprise a thermoplastic with a lower modulus region that comprises an elastomer may have a much larger difference when a system where both regions comprise elastomers.

The sealing elements can be made by any suitable techniques. For example, standard sealing manufacturing techniques may be used for their construction. In some embodiments, the reinforcing agent (e.g., fibers) may be incorporated into the matrix material (e.g., elastomer) either directly or as a masterbatch. For example, the reinforcing agent incorporated into the matrix material through shear mixing method using two roll mill or internal mixers. In some embodiments, A preform to be made from the rubber compound using extrusion, punching or through any similar process. Preform can be made as a single material with lower and higher modulus regions or can be made as two separate preforms and can be joined together in molding. Both the lower and higher modulus region portion should be with similar cure characteristics to ensure proper bonding. Molding of the preform can be done through compression molding or through transfer molding, for example.

The sealing element can be used for a variety of different downhole sealing applications. For example, the sealing element may be an O-ring seal, D-seal, T-seal, V-seal, X-seal, flat seal, lip seal, back-up ring, or a packing element. The sealing element can have a variety of different configurations. For example, the lower modulus region and the higher modulus region can be arranged in the sealing element with respect to one another in a variety of different configurations. In some embodiments, the sealing element may generally be annular in shape. In some embodiments, the higher modulus region forms at least a portion of an outer surface of the sealing element. In some embodiment, the higher modulus region may form a core of the sealing element, for example, to provide a reinforced core. In some embodiments, the higher modulus region may be disposed in one or more corners of the sealing element, for example, to provide reinforced corners. In some embodiments, the higher modulus region may be disposed on one or more ends of the sealing element, for example, to provide reinformed ends. The higher modulus region may be disposed on interfaces (e.g., corners, ends, outer surfaces, etc.) between components, for example, to reinforce these regions that would otherwise have an extrusion gap that would be susceptible to damage. By reinforcing the interfaces with the higher modulus region, the softer systems may be protected from damage.

FIG. 1 illustrates a downhole system 100 that includes a sealing element in the form of packing element 102. Surface equipment 104 may be disposed above a formation 106. As illustrated, surface equipment 104 may include a hoisting apparatus 108 and a derrick 110. Hoisting apparatus 108 may be used for raising and lowering pipe strings, such as a conveyance line 112. Conveyance line 112 may include any suitable means for providing mechanical conveyance for packer setting assembly 102, including, but not limited to, wireline, slickline, coiled tubing, tubing string, pipe, drill pipe, drill string or the like. In some examples, conveyance line 112 may provide mechanical suspension, as well as electrical connectivity, for downhole tools. As illustrated, downhole tools may be disposed on and/or around conveyance line 112. This may allow an operator to actuate packer 102 to seal off a portion of a wellbore 114.

As illustrated, downhole tools may be run into wellbore 104 on conveyance line 112. Wellbore 114 may extend through the various earth strata including formation 106. A casing 116 may be secured within wellbore 114 by cement (not shown). Casing 116 may be made from any material such as metals, plastics, composites, or the like, may be expanded or unexpanded as part of an installation procedure. Additionally, it is not necessary for casing 116 to be cemented into wellbore 114. In examples, production tubing 118 may be secured within casing 116. Production tubing 118 may be any suitable tubing string utilized in the production of hydrocarbons. In examples, production tubing may be permanently disposed within casing 116 by cement (not shown). Packer 102 may be disposed on or near production tubing 118.

Without limitation, any suitable type of packing element 102 may be used. In general, a packing elements may be device that can be run into a wellbore with a smaller initial outside diameter that then expands externally to seal the wellbore. The packing element 102 may employ flexible, elastomeric elements that expand. The packing element 102 may be a production packer, test packer, isolation packer, etc. A production packer may isolate the annulus (e.g., between the production tubing and the wellbore wall) and anchor or secure the bottom of the production tubing string. The packing element 102 incorporates a means of securing the packer against the casing or liner wall, such as a slip arrangement, and a means (e.g., sealing elements) of creating a reliable hydraulic seal to isolate the annulus, typically by means of an expandable elastomeric element. Packers, such as packing element 102, are typically classified by application, setting method and possible retrievability. Suitable types of packers may include whether they are permanently set or retrievable, mechanically set, hydraulically set, and/or combinations thereof.

While not separately shown, packing element 102 comprises a lower modulus region and a higher modulus region, as described in more detail herein. Packing element 102 may be set downhole to seal off a portion of wellbore 114. When set, packing element 102 may isolate zones of the annulus between wellbore 114 and a tubing string by providing a seal between production tubing 118 and casing 116. In examples, packing element 102 may be disposed on production tubing 118. The downhole tools may be disposed around conveyance line 112 and run into wellbore 114 when desired to actuate packer 102. Downhole tools may temporarily couple to packer 102 to initiate a sealing operation within wellbore 114.

It should be understood by those skilled in the art that present examples are equally well suited for use in wellbores having other directional configurations including vertical wellbore, horizontal wellbores, deviated wellbores, multilateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an onshore operation, it should be understood by those skilled in the art that the packer of the present invention is equally well suited for use in offshore operations. In addition, while FIG. 1 depicts use of packing element in a cased portion of wellbore 114, it should be understood that packing element may also be used in uncased portions of wellbore 114.

Figure 2:
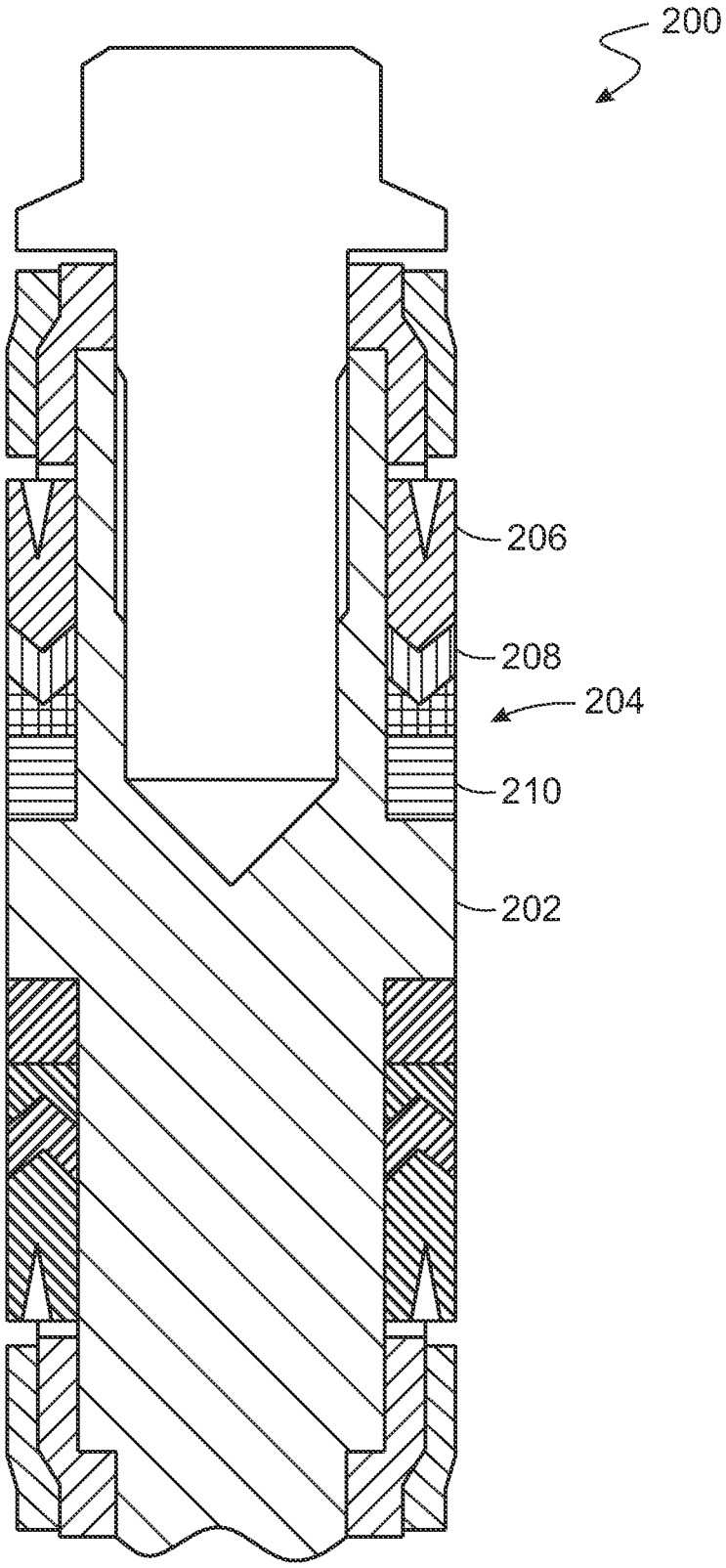
FIG. 2 illustrates a sealing element disposed on a mandrel in accordance with some embodiments of the present disclosure.

FIG. 2 is a downhole tool 200 to be disposed in a borehole (e.g., wellbore 114 of FIG. 1). The downhole tool 200 as installed in the wellbore may be permanently set or retrievable, mechanically set, hydraulically set, and/or combinations thereof. The downhole tool 200 (e.g., packer) may include a mandrel 202 (tool mandrel) and a seal stack 204 disposed about the mandrel 202. The seal stack 204 may be an assembly of individual sealing elements 206, 208, 210 utilized to seal off a portion of wellbore 10. While not separately shown, one or more of the sealing elements 206, 208, 210 may be or include a lower modulus region and a higher modulus region. The material selection for the sealing elements may be to tailor properties of the sealing elements 206, 208, 210, such as hardness, elasticity, gas resistance, chemical resistance, temperature resistance, and high temperature strength, among others. As in the illustrated implementation, the individual sealing elements 206, 208, 210, within seal stack 204 may be of differing size, height, and/or shape. Without limitation, a shape may include, for example, cross-sectional shapes that are circular, elliptical, triangular, rectangular, square, hexagonal, and/or combinations thereof.

Figure 3:
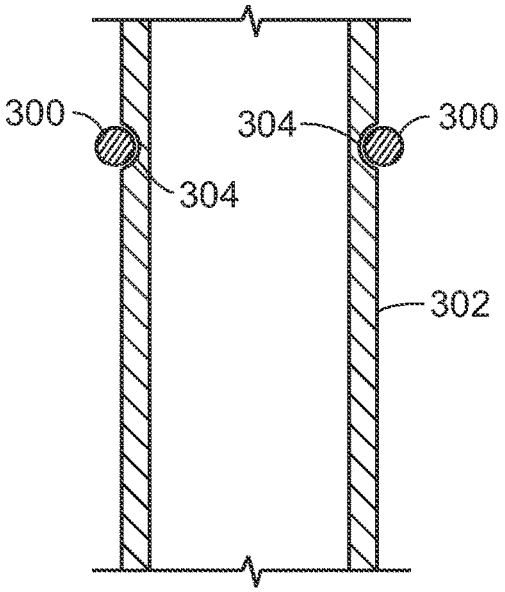
FIG. 3 illustrates a sealing element disposed on a mandrel in accordance with some embodiments of the present disclosure.
Figure 4A:
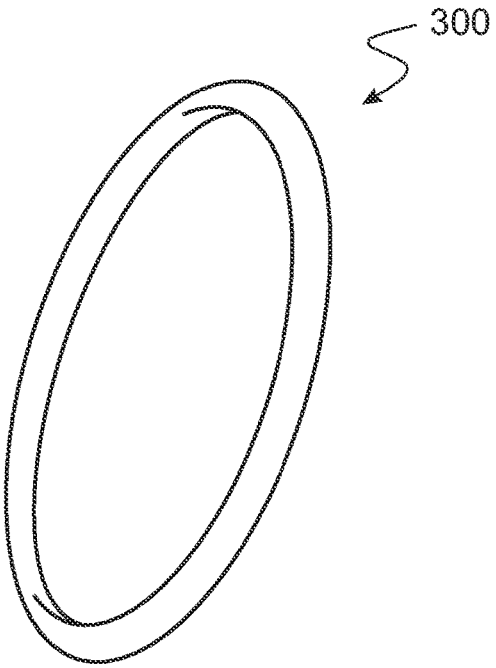
FIG. 4A illustrates a sealing element as an O-ring in accordance with some embodiments of the present disclosure.
Figure 4B:
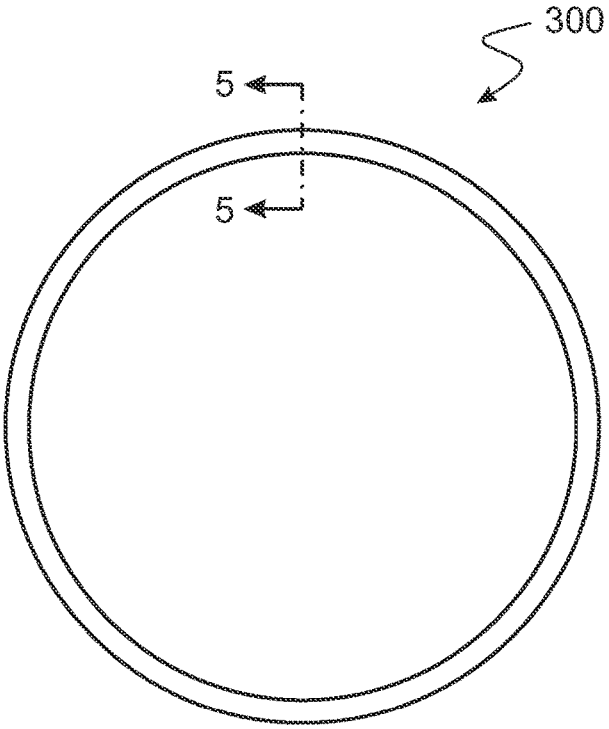
FIG. 4B illustrates a rotated view of the sealing element of FIG. 4A in accordance with some embodiments of the present disclosure.

FIGS. 3, 4A, and 4B depict an O-ring 300 in accordance with one or more embodiments. FIG. 3 shows the O-ring 300 on a mandrel 302. As illustrated, the O-ring may be disposed in a circumferential groove 304 formed on the mandrel 302. The mandrel 302 (e.g., tool mandrel) is a mandrel of a downhole tool to be disposed in a wellbore (e.g., borehole 116 shown on FIG. 1). While not shown separately, the O-ring 400 may include a lower modulus region and a higher modulus region as described in more detail herein. The O-ring 300 may be provided on the mandrel 302 to provide a seal, for example, between the mandrel 302 and another concentric tubular (not shown).

Figure 5:
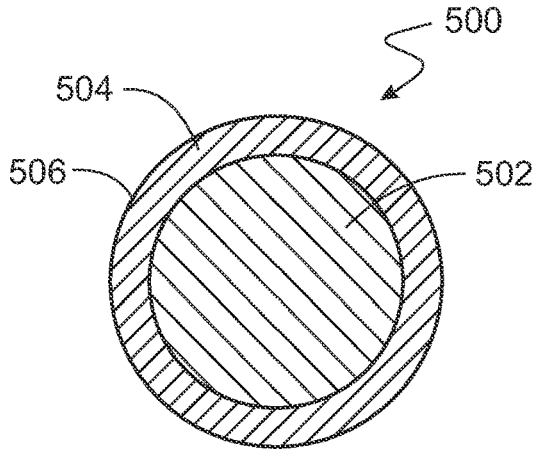
FIG. 5 illustrates a cross-sectional view of a sealing element in accordance with some embodiments of the present disclosure.

FIG. 5 illustrates a sealing element 500 in accordance with one or more embodiments. FIG. 5 is a cross-sectional view of FIG. 4A taken along plane 5. While not shown, the sealing element 500 may disposed on a tool mandrel (e.g., mandrel 302 on FIG. 3) for insertion into a wellbore (e.g., borehole 116 on FIG. 1). As illustrated, sealing element 500 includes a lower modulus region 502 and a higher modulus region 504. In the illustrated embodiment, the lower modulus region 502 forms an internal core of the sealing element 500 while the higher modulus region 504 forms at least a portion of an exterior surface 506 of the sealing element 500. As illustrated, the higher modulus region 504 may extend complete around the internal core of the lower modulus region 502 such that that higher modulus region 504 may form entire exterior surface 506 of the sealing element 500. This particular configuration may enable use a higher modular region in an application that would otherwise require a lower modulus, for example, due to a smaller diameter and thicker cross-section.

Figure 6:
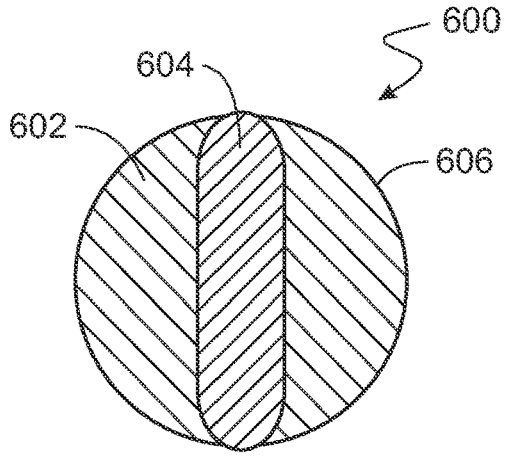
FIG. 6 illustrates a cross-sectional view of an alternative configuration of a sealing element in accordance with some embodiments of the present disclosure.

FIG. 6 illustrates a sealing element 600 in accordance with one or more embodiments. FIG. 6 is a cross-sectional view of FIG. 4A taken along plane 5. While not shown, the sealing element 600 may disposed on a tool mandrel (e.g., mandrel 302 on FIG. 3) for insertion into a wellbore (e.g., borehole 116 on FIG. 1). As illustrated, sealing element 600 includes a lower modulus region 602 and a higher modulus region 604. In the illustrated embodiment, the higher modulus region 604 forms at least a portion of an internal core of the sealing element 600 while the lower modulus region 602 forms at least a portion of an exterior surface 606 of the sealing element 600. As illustrated, the lower modulus region 602 may extend complete around the internal core of the higher modulus region 604.

Figure 7:
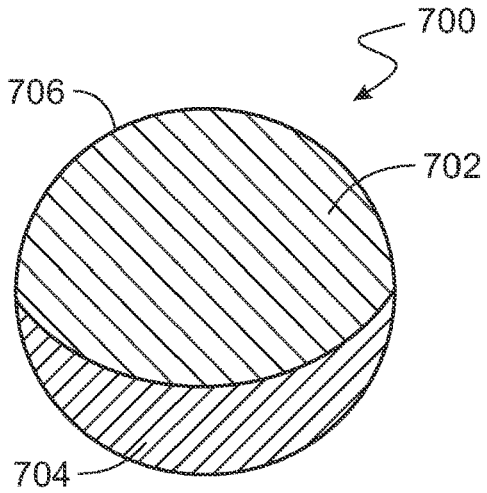
FIG. 7 illustrates a cross-sectional view of an alternative configuration of a sealing element in accordance with some embodiments of the present disclosure.

FIG. 7 illustrates a sealing element 700 in accordance with one or more embodiments. FIG. 7 is a cross-sectional view of FIG. 4A taken along plane 5. While not shown, the sealing element 700 may disposed on a tool mandrel (e.g., mandrel 302 on FIG. 3) for insertion into a wellbore (e.g., borehole 116 on FIG. 1). As illustrated, sealing element 700 includes a lower modulus region 702 and a higher modulus region 704. In the illustrated embodiment, the higher modulus region 604 forms at least a portion of an internal core of the exterior surface 606 of the sealing element 600 while the lower modulus region 602 forms another portion of the exterior surface 606. In the illustrated embodiment, the higher modulus region 604 is disposed at a bottom of the sealing element 700, for example, to contact the tool mandrel (e.g., mandrel 302 on FIG. 3). The configuration of FIG. 7 may be used, for example, where the sealing element 700 may experience one directional pressure.

Figure 8:
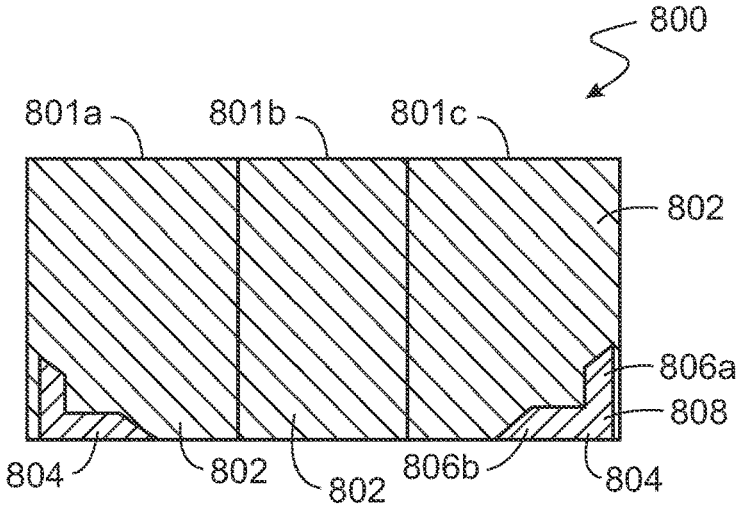
FIG. 8 illustrates a cross-sectional view of an alternative configuration of a sealing element in accordance with some embodiments of the present disclosure.

FIG. 8 illustrates a sealing element 800 in accordance with one or more embodiments. While not shown, the sealing element 800 may disposed on a tool mandrel (e.g., mandrel 302 on FIG. 3) for insertion into a wellbore (e.g., borehole 116 on FIG. 1). The sealing element 800 includes three segments, identified on FIG. 8 as first segment 801*a*, second segment 801*b*, and third segment 801*c*. The segments 801*a*, 801*b*, and 801*c* of the sealing element may be a unitary body or may be discrete elements coupled to one another. First segment 801*a* and third segment 801*c* each include a lower modulus region 802 and a higher modulus region 804. The second segment 801*b* includes a lower modulus region 802 but does not include a higher modulus region 804. As illustrated, the higher modulus region 804 may be located in at least one corner of the sealing element 800. For example, the higher modulus region 804 may be located in a corner of the first segment 801*a* and a corner of the second segment 801*c*. The higher modular region 804 may be located in lower corners of the first and second segments 801*a*, 801*c*, for example, to contact the tool mandrel (e.g., mandrel 302 on FIG. 3) and/or adjacent components. In the illustrated embodiment, the higher modulus region 804 is angled, for example, with extension segments 806*a* and 806*b* extending from a corner 808. In the illustrated embodiment, the extension segments 806*a* and 806*b* formed an approximately 90-degree angle at the corner 80. However, the extension segments 806*a* and 806*b* may be otherwise formed with an angle that is greater or less than 90 degrees.

Figure 9:
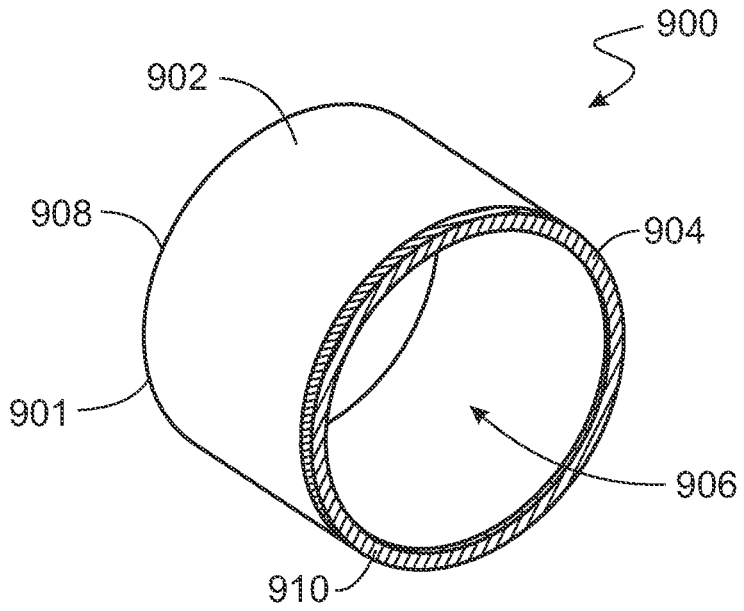
FIG. 9 illustrates a cross-sectional view of an alternative configuration of a sealing element in accordance with some embodiments of the present disclosure.

FIG. 9 illustrates a sealing element 900 in accordance with one or more embodiments. The sealing element 900 includes a body portion 901 having a lower modulus region 902 and a higher modulus region 904. The body portion 901 is in the form of sleeve that may disposed on a tool mandrel (e.g., mandrel 302 on FIG. 3) for insertion into a wellbore (e.g., borehole 116 on FIG. 1). The body portion 901 further includes a central bore 906. The body portion 901 has a first end 908 and a second end 910. The higher modulus region 904 may be positioned at one or more ends of the body portion 901. As illustrated, the higher modulus region 904 may be positioned at the second end 910, for example, to the tool mandrel (e.g., mandrel 302 on FIG. 3) and/or adjacent equipment. For example, the higher modulus region 904 may be in the form of a ring at the second end 910.

Figure 10:
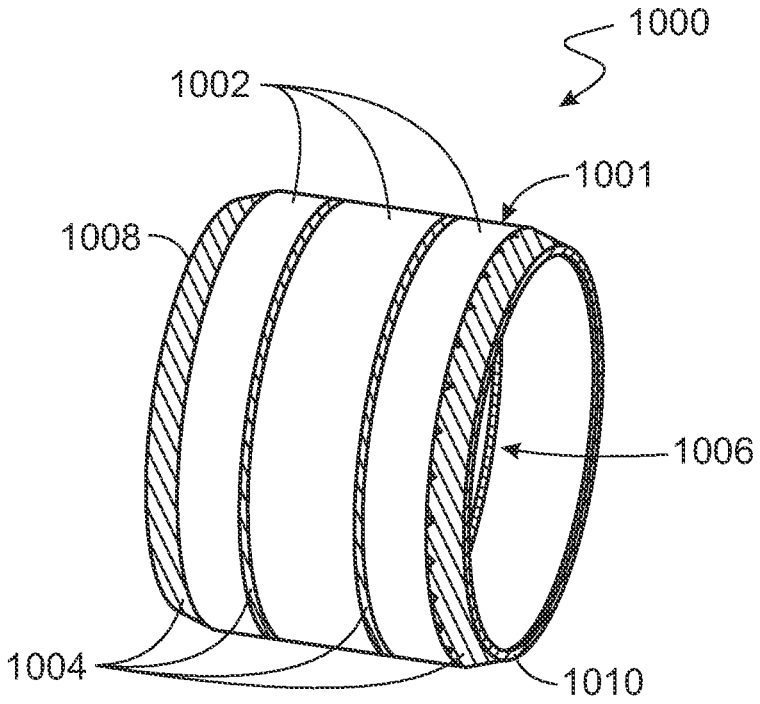
FIG. 10 illustrates a cross-sectional view of an alternative configuration of a sealing element in accordance with some embodiments of the present disclosure.

FIG. 10 illustrates a sealing element 1000 in accordance with one or more embodiments. The sealing element 1000 includes a body portion 1001 having a lower modulus region 1002 and a plurality of higher modulus regions 1004. The body portion 1001 is in the form of sleeve that may disposed on a tool mandrel (e.g., mandrel 302 on FIG. 3) for insertion into a wellbore (e.g., borehole 116 on FIG. 1). The body portion 1001 further includes a central bore 1006. The body portion 1001 has a first end 1008 and a second end 1010. The higher modulus regions 1004 may be positioned at one or more ends of the body portion 1001. As illustrated, the higher modulus region 1004 may be positioned at both the first end 1008 and the second end 1010, for example, to contact the tool mandrel (e.g., mandrel 302 on FIG. 3) and/or adjacent equipment. For example, one of the higher modulus regions 1008 may be in the form of a ring at the first end 1008. By way of further example, the another of the higher modulus regions 1008 may be in the form of a ring at the second end 1010. Additional portions of the higher modulus regions 1008 may be in the form of rings positioned in the body portion 1001. As illustrated, these additional portions of the higher modulus regions 1008 may spaced axially along the body portion 1001.

Figure 11:
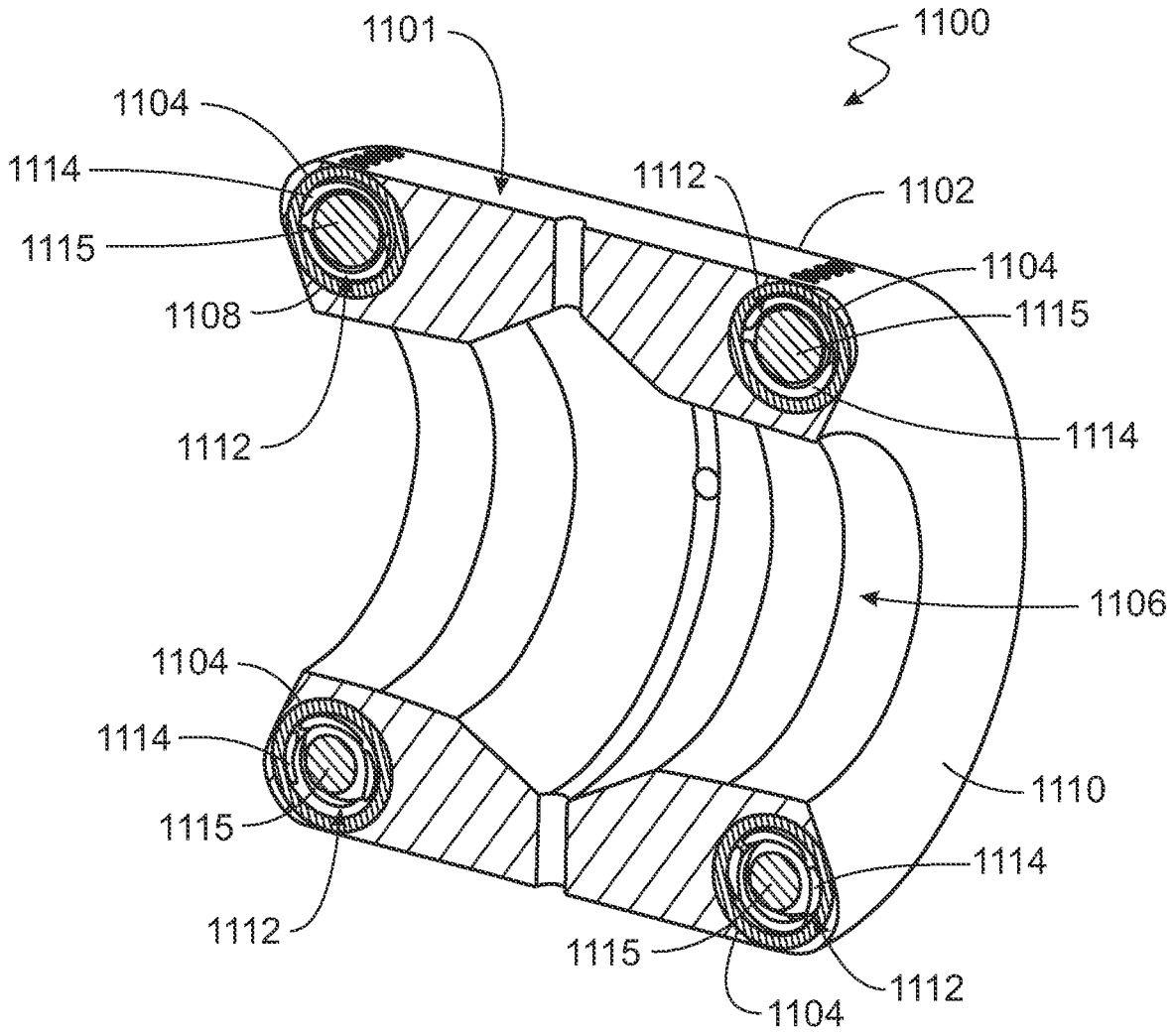
FIG. 11 illustrates a cross-sectional view of an alternative configuration of a sealing element in accordance with some embodiments of the present disclosure.

FIG. 11 illustrates a sealing element 1100 in accordance with one or more embodiments. The sealing element 1100 includes a body portion 1101 having a lower modulus region 1102 and at least one higher modulus region 1104. The body portion 1101 is in the form of sleeve that may be disposed on a tool mandrel (e.g., mandrel 302 on FIG. 3) for insertion into a wellbore (e.g., borehole 116 on FIG. 1). The body portion 1101 further includes a central bore 1106. The body portion 1101 has a first end 1108 and a second end 1110. The at least one higher modulus region 1104 may be positioned at one or more ends of the body portion 1101. As illustrated, the at least one higher modulus region 1104 may be positioned at both the first end 1108 and the second end 1110. In the illustrated embodiment, the at least one higher modulus region may be in the form of a hollow ring having an annular cavity 1112 disposed therein. In some embodiments, the sealing element 1100 may further include spring elements 1114. As illustrated, a respective one of the spring elements 1114 may be disposed in each of the annular cavities 1112, for example, so that the at least one higher modulus region 1104 is in contact with the spring elements 1114 rather than the lower modulus region 1103, thus optimizing the sealing element 1100 for use with the spring elements 1114. In some embodiments, the spring elements 1114 may be a garter spring or another suitable spring. As illustrated, the garter springs 1114 may include a filler material 1115, such as a low-modulus rubber or ball bearings disposed within the springs.

Accordingly, the present disclosure may provide sealing elements that comprise a region of localized fiber loading. The methods and systems may include any of the various features disclosed herein, including one or more of the following statements.

Statement 1. A downhole tool for use in a well, comprising: a tool mandrel; a sealing element disposed about the mandrel, wherein the sealing element comprises a lower modulus region and a higher modulus region.

Statement 2. The downhole tool of Statement 1, wherein the higher modulus region comprises a reinforcing agent and a matrix.

Statement 3. The downhole tool of Statement 2, wherein the reinforcing agent comprises a powder, a metal, a fiber, or a combination thereof.

Statement 4. The downhole tool of any one of Statements 1-3, wherein the higher modulus region comprises fibers disposed in a matrix.

Statement 5. The downhole tool of Statement 4, wherein the fibers are present in an amount of about 1% to about 40% by volume of the higher modulus region.

Statement 6. The downhole tool of Statement 4 or Statement 5, wherein the lower modulus region is present in an amount of about 50% to about 99% by volume of the sealing element, and wherein the higher modulus region is present in an amount of about 1% to about 50% by volume of the sealing element.

Statement 7. The downhole tool of any one of Statements 1-6, wherein the higher modulus region surrounds an inner core of the lower modulus region, and wherein the higher modulus region forms at least a portion of an exterior surface of the sealing element.

Statement 8. The downhole tool of any one of Statements 1-7, wherein the higher modulus region forms a core of the sealing element.

Statement 9. The downhole tool of any one of Statements 1-7, wherein the higher modulus region is positioned in one or more corners of the sealing element.

Statement 10. The downhole tool of any one of Statements 1-7, wherein the higher modulus region forms at least a portion of a surface at a bottom of the sealing element while the lower modulus region forms at least a portion of a surface at a top of the sealing element.

Statement 11. The downhole tool of any one of Statements 1-7, wherein the higher modulus region is positioned at one or more ends of a body portion of the sealing element, and wherein the body portion has a central bore.

Statement 12. The downhole tool of Statement 11, wherein the higher modulus region comprises portions that are positioned at both ends of a body portion of the sealing element, and wherein the body portion has a central bore.

Statement 13. The downhole tool of Statement 12, wherein additional portions of the higher modulus region are rings spaced axially along the body portion between the ends of the body portion.

Statement 14. The downhole tool of any one of Statements 1-13, wherein the higher modulus portion comprises at least one hollow ring with an annular cavity, and wherein the sealing element further comprises a ring disposed in the annular cavity.

Statement 15. The downhole tool of any one of Statements 1-14, wherein the downhole tool is a packer.

Statement 16. The downhole tool of any one of Statements 1-15, wherein the downhole tool comprises an annular body.

Statement 17. A method of sealing a borehole, comprising: moving a tool mandrel to a selected position in the borehole, wherein a sealing element is disposed about the mandrel, wherein the sealing element comprises a lower modulus region and a higher modulus region; and positioning the sealing element in the borehole to form a seal between the sealing element and an adjacent surface.

Statement 18. The method of Statement 17, wherein the higher modulus region comprises fibers disposed in a matrix.

Statement 19. The method of Statement 18, wherein the lower modulus region is present in an amount of about 50% to about 99% by volume of the sealing element, and wherein the higher modulus region is present in an amount of about 1% to about 50% by volume of the sealing element.

Statement 20. The method of any one of Statements 17-19, wherein the higher modulus portion comprises at least one hollow ring with an annular cavity, and wherein the sealing element further comprises a ring disposed in the annular cavity.

To facilitate a better understanding of the present invention, the following examples of certain aspects of some embodiments are given. In no way should the following examples be read to limit, or define, the entire scope of the disclosure.

EXAMPLES

Testing was performed to evaluate failure performance for a sealing element in accordance with one or embodiments. The sealing element tested was an O-ring as shown on FIG. 7. The lower modulus region comprised 60% of the sealing element by volume and the higher modulus region comprised 40% of the sealing element by volume. The lower modulus and higher modulus regions were both an elastomeric material with the higher modulus region containing aramid fibers in an amount of 10% by volume. The performance of the sealing element was compared to a standard sealing element without the fibers.

To evaluate failure performance, testing was carried out under hydraulic differential pressure. Test specimens were prepared according to FIG. 7 and loaded on to the test fixture with 15% squeeze and 0.012 inch diametrical gap. The seals were then pressurized until failure. The testing was done for each sealing element at 250° C. and 275° C.

Figure 12:
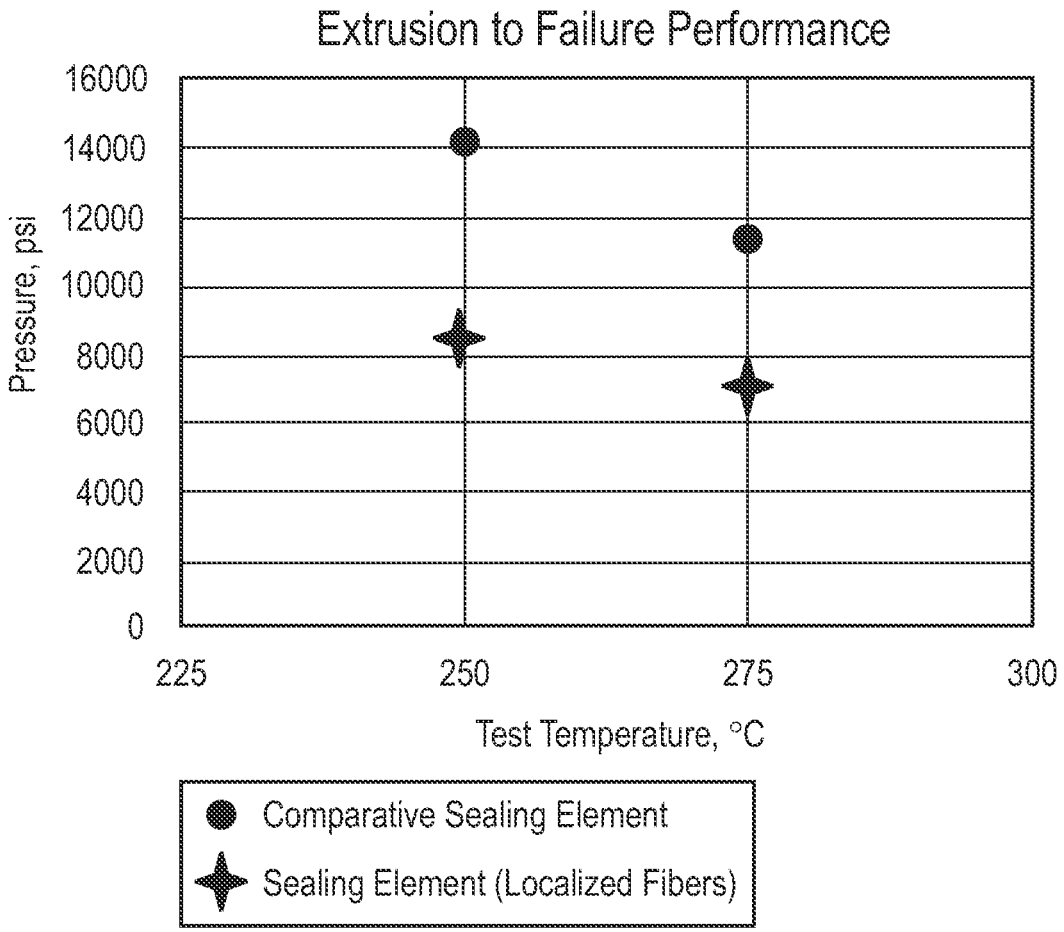
FIG. 12 is a chart illustrating extrusion to failure performance for sealing elements in accordance with some embodiments of the present disclosure.

The results of the testing are shown on FIG. 12. The failure pressure is shown with respect to test temperature. As shown, the sealing element with the lower modulus region containing aramid fibers had increased performance with respect to the comparative sealing element. At 250° C., the sealing element with aramid fibers was able to sustain a pressure of over 5,000 psi greater than the comparative sealing element. At 275° C., the sealing element with aramid fibers was able to sustain a pressure of over 3,000 psi greater than the comparative sealing element.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole tool for use in a well, comprising:

a tool mandrel; and a sealing element disposed about the tool mandrel, wherein the sealing element comprises a localized loading of a reinforcing agent giving a lower modulus region and a higher modulus region, wherein the higher modulus region comprises portions that are positioned respectively at both ends of a body portion of the sealing element, the higher modulus region comprising at least one additional portion each as a ring spaced axially along the body portion between the ends of the body portion, wherein the body portion has a central bore, and wherein the higher modulus region forms at least part of an exterior surface of the sealing element.

2. The downhole tool of claim 1, wherein the higher modulus region comprises a reinforcing agent and a matrix.

3. The downhole tool of claim 2, wherein the reinforcing agent comprises a powder, a metal, or a fiber, or any combinations thereof.

4. The downhole tool of claim 2, wherein the matrix comprises a thermoplastic, and wherein the lower modulus region comprises an elastomer.

5. The downhole tool of claim 2, wherein the matrix comprises a same material as the lower modulus region.

6. The downhole tool of claim 2, wherein the matrix is a different material than the lower modulus region.

7. The downhole tool of claim 1, wherein the localized loading of the reinforcing agent comprises a localized fiber loading, and wherein the higher modulus region comprises fibers disposed in a matrix.

8. The downhole tool of claim 7, wherein the fibers are present in an amount of about 1% to about 40% by volume of the higher modulus region.

9. The downhole tool of claim 7, wherein the downhole tool is a packer, wherein the lower modulus region is present in an amount of about 50% to about 99% by volume of the sealing element, and wherein the higher modulus region is present in an amount of about 1% to about 50% by volume of the sealing element.

10. The downhole tool of claim 1, wherein the lower modulus region comprises an elastomer, wherein the higher modulus region does not comprise an elastomer, and wherein the higher modulus region comprises a thermoplastic.

11. A downhole tool for use in a well, comprising:

a tool mandrel; and a sealing element disposed about the tool mandrel, wherein the sealing element comprises a localized loading of a reinforcing agent giving a lower modulus region and a higher modulus region, wherein the higher modulus region comprises portions that are positioned respectively at both ends of a body portion of the sealing element, wherein additional portions of the higher modulus region are rings spaced axially along the body portion between the ends of the body portion, and wherein the body portion has a central bore.

12. The downhole tool of claim 11, wherein the body portion is in form of a sleeve disposed on the tool mandrel.

13. The downhole tool of claim 11, wherein the downhole tool is a packer, and wherein the higher modulus region comprises the reinforcing agent and a matrix.

14. A method of sealing a borehole, comprising:

moving a tool mandrel to a selected position in the borehole, wherein a sealing element is disposed about the tool mandrel, wherein the sealing element comprises a localized loading of a reinforcing agent giving a lower modulus region and a higher modulus region, wherein the higher modulus region comprises a hollow ring with an annular cavity, and wherein the sealing element further comprises a spring element disposed in the annular cavity; and positioning the sealing element in the borehole to form a seal between the sealing element and an adjacent surface.

15. The downhole tool of claim 14, wherein the spring element includes the lower modulus region.

16. The method of claim 14, wherein the higher modulus region is in contact with the spring element rather than the lower modulus region, wherein the localized loading of the reinforcing agent comprises a localized fiber loading, and wherein the higher modulus region comprises fibers disposed in a matrix.

17. The method of claim 14, wherein the lower modulus region is present in an amount of about 50% to about 99% by volume of the sealing element, and wherein the higher modulus region is present in an amount of about 1% to about 50% by volume of the sealing element.

18. The method of claim 14, wherein the matrix and the lower modulus region comprise a same material, and wherein the spring element comprises a garter spring having filler material comprising rubber or ball bearings, or both.

* * * * *